US009287647B2

(12) United States Patent
Swoboda

(10) Patent No.: US 9,287,647 B2
(45) Date of Patent: Mar. 15, 2016

(54) ELECTRICAL ZERO-FORCE PLUG CONNECTOR

(71) Applicant: Kostal Kontakt Systeme GmbH, Luedenscheid (DE)

(72) Inventor: Artur Swoboda, Iserlohn (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 0 days.

(21) Appl. No.: 14/625,735

(22) Filed: Feb. 19, 2015

(65) Prior Publication Data

US 2015/0162688 A1 Jun. 11, 2015

Related U.S. Application Data

(63) Continuation of application No. PCT/EP2013/071900, filed on Oct. 18, 2013.

(30) Foreign Application Priority Data

Oct. 23, 2012 (DE) ..... 10 2012 020 767

(51) Int. Cl.
*H01R 13/15* (2006.01)
*H01R 13/193* (2006.01)
(Continued)

(52) U.S. Cl.
CPC ..... *H01R 13/193* (2013.01); *H01R 13/6271* (2013.01); *H01R 13/639* (2013.01)

(58) Field of Classification Search
CPC .... H01R 13/62; H01R 13/193; H01R 13/631; H01R 13/18
USPC ..... 439/263, 268, 347, 265, 364
See application file for complete search history.

(56) References Cited

U.S. PATENT DOCUMENTS 7,232,323 B2 * 6/2007 Mohs ..... H01R 13/18 439/265
7,267,583 B1 * 9/2007 Smith ..... H01R 13/193 439/660

(Continued)

FOREIGN PATENT DOCUMENTS

DE 19650098 A1 6/1997
DE 19908469 A1 9/2000

(Continued)

OTHER PUBLICATIONS

European Patent Office, International Search Report for the International Application No. PCT/EP2013/071900 mailed Jan. 8, 2014.

(Continued)

*Primary Examiner* — Abdullah Riyami
*Assistant Examiner* — Nader J Alhawamdeh
(74) *Attorney, Agent, or Firm* — Brooks Kushman P.C.

(57) ABSTRACT

An electrical zero-force plug connector includes a socket housing holding sleeve contacts movable between opened and closed positions and an assembly connector having connector pins. A bolt is movable against the socket housing from an unlocked position into a locked position after the socket housing and the assembly connector are joined. A slider is connected to the bolt and the sleeve contacts such that as the bolt moves the slider moves through a seal of the socket housing and moves the sleeve contacts. While the socket housing and the assembly connector are joined and the bolt is unlocked, the sleeve contacts are opened and the connector pins are inserted into the sleeve contacts. While the socket housing and the assembly connector are joined and the bolt is locked, the sleeve contacts are closed and the connector pins inserted into the sleeve contacts are held therein.

20 Claims, 3 Drawing Sheets

(51) Int. Cl.
*H01R 13/627* (2006.01)
*H01R 13/639* (2006.01)

(56) References Cited

U.S. PATENT DOCUMENTS

| | | | | |
|---|---|---|---|---|
| 7,588,454 | B2 * | 9/2009 | Nakata | H01R 13/6277 439/352 |
| 8,246,368 | B2 * | 8/2012 | Buethe | H01R 13/641 439/259 |
| 9,099,805 | B2 * | 8/2015 | Hiramatsu | H01R 13/6272 |
| 2007/0049088 | A1 | 3/2007 | Mohs et al. | |
| 2012/0142205 | A1 | 6/2012 | Buethe et al. | |
| 2014/0106598 | A1 * | 4/2014 | Hiramatsu | H01R 13/6277 439/350 |
| 2014/0106602 | A1 * | 4/2014 | Hiramatsu | H01R 13/6272 439/357 |

FOREIGN PATENT DOCUMENTS

| | | | |
|---|---|---|---|
| DE | 102005040952 | A1 | 3/2007 |
| DE | 102008012925 | A1 | 9/2009 |
| DE | 102009057688 | A1 | 6/2011 |

OTHER PUBLICATIONS

The International Bureau of WIPO, International Preliminary Report on Patentability for International Application No. PCT/EP2013/071900 mailed May 7, 2015.

* cited by examiner

ELECTRICAL ZERO-FORCE PLUG CONNECTOR

CROSS-REFERENCE TO RELATED APPLICATIONS

This application is a continuation of International Application No. PCT/EP2013/071900, published in German, with an International filing date of Oct. 18, 2013, which claims priority to DE 10 2012 020 767.0, filed Oct. 23, 2012, the disclosures of which are hereby incorporated in their entity by reference herein.

TECHNICAL FIELD

The present invention relates to an electrical zero-force plug connector including a plug sleeve housing having receptacles for sleeve contacts and an assembly connector having connector pins for connecting with the sleeve contacts; each sleeve contact has a base body, which forms contact blades, and a clamping sleeve that can slide relative to the base body and when the clamping sleeves of the sleeve contacts move with respect to the base body the clamping sleeves press the contact blades against the connector pins of the assembly connector; and the plug sleeve housing further has a spring-action latching hook and a seal and the assembly connector further has a detent, and the latching hook latches with the detent and the seal bears against an inner wall of the assembly connector after the plug sleeve housing and the assembly connector are joined.

BACKGROUND

DE 10 2005 040 952 A1 (corresponds to U.S. Pat. No. 7,232,323) describes such an electrical zero force plug connector. This plug connector includes a plug sleeve housing (or socket housing) and an assembly connector. The socket housing has two housing parts including a protective housing part and a locking housing part. The housing parts can be inserted into one another in two latching positions. The clamping sleeves of the sleeve contacts are connected to the protective housing part. When the housing parts are in a first latching position, the clamping sleeves are held open so that connector pins of the assembly connector (i.e., the mating connector) can be connected almost force-free to the sleeve contacts. Insertion of the assembly connector releases the lock of the latching connection between the housing parts. This brings the housing parts together into a second latching position with respect to one another. When the housing parts are in the second latching position, contact blades of the sleeve contacts are compressed against the connector pins of the assembly connector.

The latching mechanism between the housing parts enables the connector pins of the assembly connector to be inserted almost force-free into the sleeve contacts. A contact force between the contact blades of the sleeve contacts and the connector pins is produced only in the final phase of inserting the connector pins into the sleeve contacts. In order that mechanical effects on the protective housing part or the assembly connector are not transmitted to the electrical contact elements connected with one another, which can cause the contact elements to become disconnected, an elastic snap-fit rocker is formed on an external wall of the protective housing part. While attaching to the assembly connector, a spring arm of the snap-fit rocker latches with a detent on the assembly connector and thereby connects both plug connector components to one another in a form-fitting manner.

Opening this latching connection as needed to separate the two plug connector components can be achieved by exerting pressure on the free spring arm of the snap-fit rocker.

In this zero force plug connector, displacement of the clamping sleeves and latching of the snap-fit rocker of the protective housing part onto the detent of the assembly connector can be achieved mechanically independently of one another. There is thus no danger that when the clamping sleeves slide the latching connection between the protective housing part and the assembly connector breaks. This is because for the mutually latched protective housing part and assembly connector the clamping sleeves also slide until they reach their end position.

SUMMARY

An object is an electrical zero-force plug connector that assures a complete electrical and mechanical connection of the connector parts.

In carrying out at least one of the above and/or other objects, an electrical zero force plug type connector includes a socket housing holding sleeve contacts movable between opened and closed positions and having a seal and an assembly connector having connector pins. The plug connector further includes a bolt movable against the socket housing from an unlocked position into a locked position after the socket housing and the assembly connector are joined. The plug connector further includes a slider extending through an opening of the seal and connected to the bolt and to the sleeve contacts such that as the bolt moves between the unlocked and locked positions the slider moves through the opening of the seal and moves the sleeve contacts between the opened and closed positions. While the socket housing and the assembly connector are joined and the bolt is in the unlocked position, the sleeve contacts are in the opened position and the connector pins are inserted into the sleeve contacts. While the the socket housing and the assembly connector are joined and the bolt is in the locked position, the sleeve contacts are in the closed position and the connector pins inserted into the sleeve contacts are held therein.

Further, in carrying out at least one of the above and/or other objects, an electrical zero force plug type connector includes sleeve contacts movable between opened and closed positions, a socket housing holding the sleeve contacts and having a hook and a seal, and an assembly connector having connector pins and a lug. This plug connector further includes a bolt arranged on the socket housing and movable against the socket housing from an unlocked position into a locked position after the socket housing and the assembly connector are joined. This plug connector further includes a slider extending through an opening of the seal and connected to the bolt and to the sleeve contacts such that as the bolt moves between the unlocked and locked positions the slider moves through the opening of the seal and moves the sleeve contacts between the opened and closed positions. While the socket housing and the assembly connector are joined and the bolt is in the unlocked position, the sleeve contacts are in the opened position, the connector pins are inserted into the sleeve contacts, and the hook latches with the lug and the seal bears on an inner wall of the assembly connector. While the socket housing and the assembly connector are joined and the bolt is in the locked position, the sleeve contacts are in the closed position, the connector pins inserted into the sleeve contacts are held therein, and the bolt locks latching of the hook with the lug.

An electrical zero-force plug connector in accordance with embodiments includes a plug sleeve housing (or socket housing) and an assembly connector. The socket housing has receptacles for sleeve contacts. The assembly connector has connector pins for connecting with the sleeve contacts. Each sleeve contact has a base body, which forms contact blades, and a clamping sleeve movably connected to the base body. When the clamping sleeves of the sleeve contacts move in relation to their base body, the clamping sleeves press the contact blades of their base body against corresponding connector pins of the assembly connector inserted into the sleeve contacts. The socket housing further has a spring-action latching hook and a seal. The assembly connector further has a latching lug. The latching hook latches with the latching lug and the seal bears against an inner wall of the assembly connector after the socket housing and the assembly connector are joined.

The plug connector further includes a bolt arranged on the socket housing. The bolt can move in relation to the socket housing into a locking position after the socket housing and the assembly connector are joined. In the locking position, the bolt locks the latching connection between the latching hook of the socket housing and the latching lug of the assembly connector.

The plug connector further includes a slider. The slider is connected to the bolt to move when the bolt moves. The slider is also coupled to the clamping sleeves. The slider is guided through an opening in the seal of the socket housing and moves through the opening when the bolt moves.

In embodiments, a bolt is arranged on the socket housing and the bolt can be slid toward the socket housing to a locking position after the socket housing and the assembly connector are joined. The bolt locks the latching connection between the latching hook of the socket housing and the latching lug of the assembly connector when the bolt is displaced into the locking position. The bolt is connected to pins of a slider. The pins are guided through respective openings of the seal of the socket housing. The slider moves with the bolt during displacement of the bolt. The slider is also coupled to the clamping sleeves of the sleeve contacts. As such, bolt movement causes slider movement and slider movement causes the clamping sleeves of the sleeve contacts to move.

The latching of the socket housing and the assembly connector and the sliding of the clamping sleeves take place by mechanically coupled elements so that both mechanical procedures can only occur together. The sliding position of the bolt, which can easily be seen from the outside, visually shows a user the displaced position of the clamping sleeves.

However, this is accompanied by the problem of mechanically grasping the clamping sleeves, which are located inside chambers formed by the socket housing connected to the assembly connector, and are protected from moisture by a seal. Omitting the seal would lead to inadequate sealing of the connector assembly.

This problem is solved by the slider connected to the bolt in which the slider is guided through an opening in the seal of the socket housing. This enables the seal to remain in its place and simultaneously seal the connection of the slider and the bolt.

It is advantageous that the bolt can slide against the socket housing only after the socket housing and the assembly connector are joined. By joining the socket housing, the bolt is thereby located in the correct assembly position, which avoids additional assembly effort. This can advantageously be achieved by providing an integrally molded projection on the bolt. The bolt projection is initially blocked by the latching hook of the socket housing and is released by unlatching the latching hook and the latching lug.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
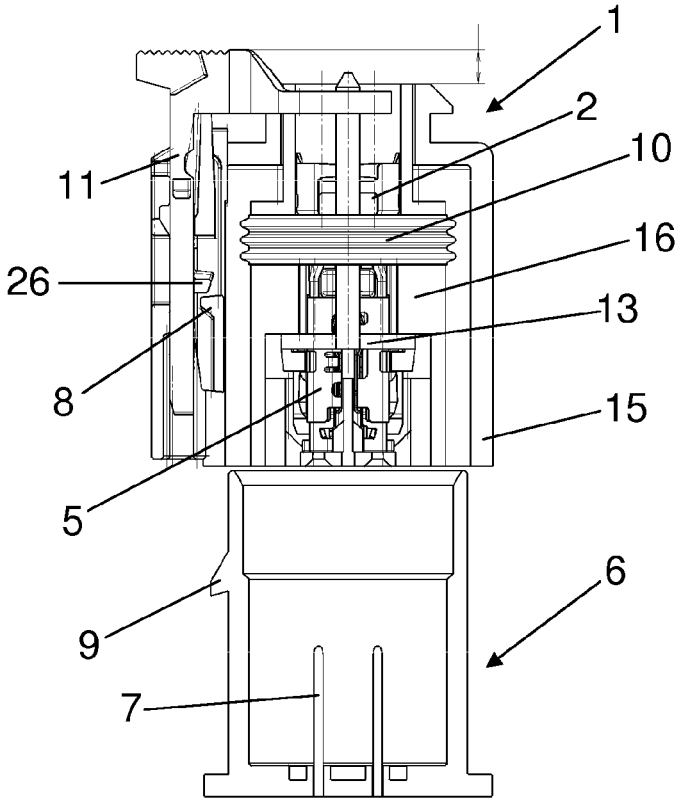
FIG. 1 illustrates the socket housing and the assembly connector of an embodiment of an electrical zero-force plug connector in an unconnected state.

An embodiment of an electrical zero-force plug connector is shown in the Figures. The plug connector includes two mutually connectable plug connector components 1 and 6. Plug connector components 1 and 6 are designated as a plug sleeve housing 1 (or socket housing 1) and an assembly connector 6. In FIG. 1, socket housing 1 and assembly connector 6 are in an unconnected state.

Socket housing 1 includes an outer protective housing 15 and an inner contact carrier 16. Protective housing 15 and contact carrier 16 are either integral or individual components which can be assembled with one another. Protective housing 15 and contact carrier 16 are shown most clearly in FIG. 5. Contact carrier 16 has a plurality of tube-like receptacles 25. Receptacles 25 are configured to receive molded metal sleeve contacts 2 respectively therein.

Assembly connector 6 includes a plurality of connector pins 7. Connector pins 7 are to inserted into and connect with respective sleeve contacts 2 when assembly connector 6 is joined to socket housing 1.

Figure 7:
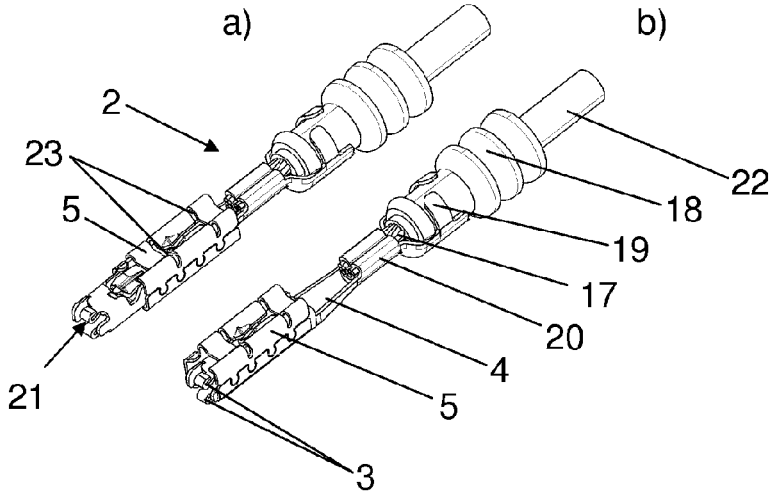
FIG. 7 illustrates a sleeve contact shown from two points of view.

FIG. 7 illustrates the component parts of a sleeve contact 2, such as described in DE 10 2005 040 952 A1 (corresponds to U.S. Pat. No. 7,232,323), in two views a) and b). Sleeve contact 2 includes a metallic base body 4. Base body 4 is connected to an electric conductor 22. In particular, conductor 22 has an electrical line 17 connected electrically and mechanically to base body 4 by a crimped connection 20. A rubber seal 18 surrounds conductor 22. Rubber seal 18 is attached in a transition region from conductor 22 to base body 4 through two flexible tabs 19 on the base body. For improved clarity, electric conductors 22 are not depicted in the remaining Figures.

The free end section of base body 4 is formed by two contact blades 3. Contact blades 3 are integrally molded on base body 4 lying alongside one another to accommodate a connector pin 7 of assembly connector 6 inserted through intermediate space 21. The ends of contact blades 3 are bent outwardly respectively. A clamping sleeve 5 partially surrounds the cross-section of base body 4 and is attached by spring pressure to the base body. Clamping sleeve 5 contains slotted apertures 23 that produce a flat spring characteristic. Clamping sleeve 5 is arranged to slide along base body 4. When clamping sleeve 5 is located in the region of contact blades 3 as shown in view b) (e.g., in a closed position), the clamping sleeve presses the contact blades together. On the other hand, when clamping sleeve 5 is moved away from contact blades 3 as shown in view a) (e.g., in an opened position), no pressure forces are applied to the clamping sleeve by the contact blades. The latter arrangement of clamping sleeve 5 on base body 4 thereby enables a connector pin 7 of assembly connector 6 to be inserted in a nearly force-free manner into intermediate space 21 between contact blades 3.

Figure 4:
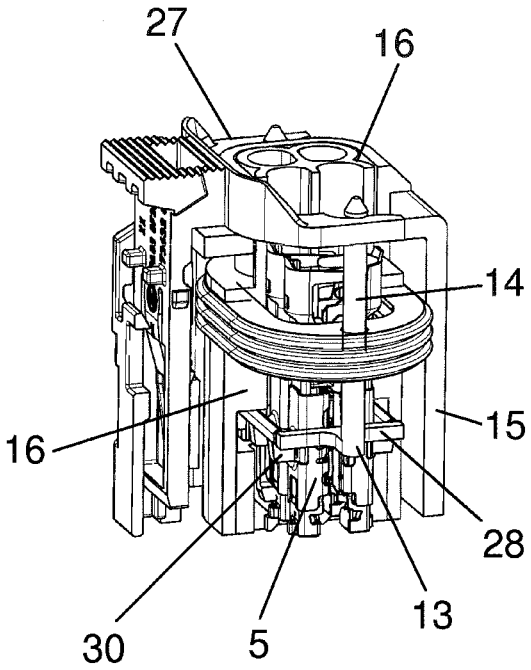
FIGS. 4 and 5 illustrate partial section views of the socket housing connected to the assembly connector.
Figure 5:
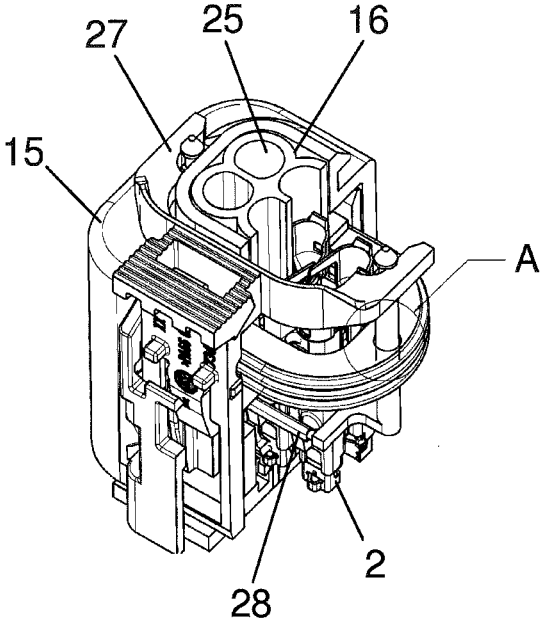

The plug connector further includes a bolt 11 and a slider 13. As shown in FIG. 1, bolt 11 is arranged to slide on outer protective housing 15. With reference to FIGS. 4 and 5, bolt 11 has a pair of arms 27 which are attached to respective pins 14 of slider 13. Pins 14 pass through respective openings 12 in rubber elastic seal 10 surrounding inner contact carrier 16. Seal 10 seals contact carrier 16 against assembly connector 6 when socket housing 1 and assembly connector 6 are assembled together.

Figure 6:
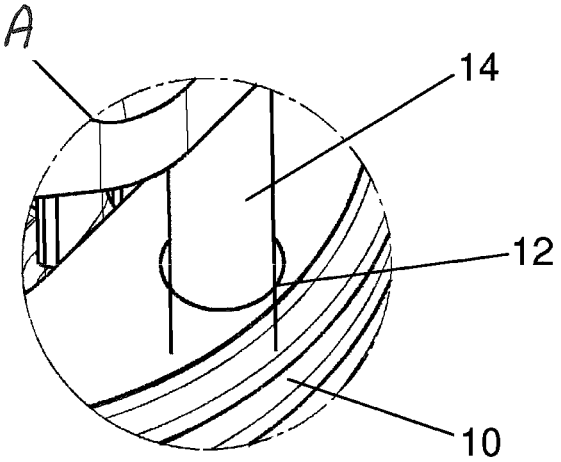
FIG. 6 illustrates a detailed view of FIG. 5.

The feeding of a pin 14 of slider 13 through an opening 12 in seal 10 is shown in FIG. 6 in a magnified view of a section A from FIG. 5. Pins 14 can slide along respective openings 12 in seal 10, wherein seal 10 always surrounds the pins. Pins 14 are shown for example as being cylindrical in shape and other cross-sectional shapes, like ovals or polygons, can be used.

Slider 13 includes a frame 28. Frame 28 is connected with the two pins 14 as shown in FIGS. 4 and 5. Molded parts 30 of frame 28 extend into slit-shaped apertures 23 of clamping sleeves 5 (apertures 23 of clamping sleeves 5 are shown in FIG. 7). A vertical motion of slider 13 thereby slides clamping sleeves 5 of sleeve contacts 2 against their base body 4.

The connection of socket housing 1 to assembly connector 6 occurs as follows. As mentioned, FIG. 1 shows socket housing 1 and assembly connector 6 in the unconnected state. Bolt 11 on socket housing 1 is in its initial position. Bolt 11 is in its initial position as spring-loaded latching hook 8 of socket housing 1 presents a barrier for a projection 26 molded on bolt 11. A displacement of bolt 11 against socket housing 1 is thereby blocked. Since clamping sleeves 5 of sleeve contacts 2 are mechanically coupled with bolt 11 through slider 13, clamping sleeves 5 are in their opened position, shown in view a) of FIG. 7. When clamping sleeves 5 are in their opened position, connector pins 7 of assembly connector 6 can be slid respectively into sleeve contacts 2.

Figure 2:
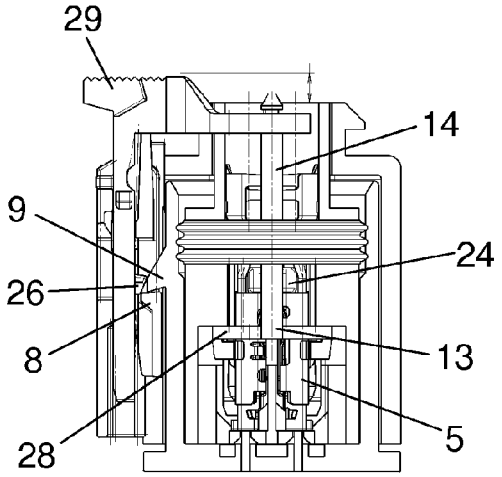
FIG. 2 illustrates the socket housing and the assembly connector in a mutually connected state with the bolt in a basic position.

Thus, socket housing 1 can be joined to assembly connector 6, wherein connector pins 7 penetrate into the appropriate sleeve contacts 2. The state of assembly achieved in this way is shown as a sectional view in FIG. 2. Latching hook 8 of socket housing 1 is now latched behind latching lug 9 of assembly connector 6. Latching lug 9 of assembly connector 6 lies on projection 26 of bolt 11, whereby projection 26 slides over latching lug 9 when acted upon by pressure on actuating element 29 of bolt 11 and bolt 11 is slid against socket housing 1.

During this sliding motion, bolt 11 entrains the mechanically coupled slider 13. Pins 14 pass through seal 10 as pins 14 are integrally connected on their underside to frame 28. Frame 28 has a number of molded parts 30 corresponding to the number of sleeve contacts 2. Molded 30 of frame 28 mechanically grip corresponding clamping sleeves 5. In addition, a secondary bolt 24 is connected to pins 14 and lies on the upper side of clamping sleeves 5. In this manner the motion of slider 13 slides clamping sleeves 5 against sleeve contacts 2, whereby contact blades 3 close the sleeve contacts 2 tightly about connector pins 7 of assembly connector 6 inserted into the sleeve contacts 2. In this state, clamping sleeves 5 are in their closed position, shown in view b) of FIG. 7.

Figure 3:
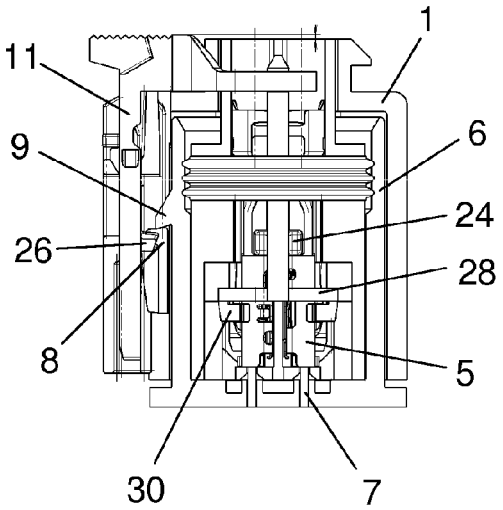
FIG. 3 illustrates the arrangement according to FIG. 2 with the bolt being displaced.

Bolt 11 of slider 13 and clamping sleeve 5 finally reach their final positions, which can be seen in FIG. 3. Bolt 11 blocks the motion of latching hook 8 and latching lug 9 relative to one another, whereby socket housing 1 and assembly connector 6 are now tightly connected to one another and stopped in place. The locking of plug connector components 1 and 6 against one another and the activation of sleeve contacts 2 by the sliding motion of clamping sleeve 5 is thus simultaneous and is accomplished in a single assembly step by sliding bolt 11.

Separation of plug connector components 1 and 6 is achieved by following the same process in reverse. In order to separate socket housing 1 and assembly connector 6 from one another, bolt 11 is first pulled, that is brought, into the position shown in FIG. 2. Socket housing 1 can then be separated from assembly connector 6.

REFERENCE SYMBOLS

1 socket housing
2 sleeve contacts
3 contact blades
4 base body
5 clamping sleeve
6 assembly connector
7 plug pins
8 latching hook
9 latching lug (detent)
10 seal
11 bolt
12 openings (recesses)
13 slider
14 pins
15 protective housing
16 contact carrier
17 conductor
18 rubber seal
19 flexible tabs
20 crimped connection
21 intermediate space
22 conductor
23 openings
24 secondary bolt
25 receptacles
26 projection
27 arms
28 frame
29 actuating element
30 molded parts
1, 6 plug connector components
A Section While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. An electrical zero force plug type connector comprising:
a plurality of sleeve contacts movable between opened and closed positions;
a socket housing holding the sleeve contacts and having a hook and a seal;
an assembly connector having connector pins and a lug;
a bolt arranged on the socket housing and movable against the socket housing from an unlocked position into a locked position after the socket housing and the assembly connector are joined; and a slider extending through an opening of the seal and connected to the bolt and to the sleeve contacts such that as the bolt moves between the unlocked and locked positions the slider moves through the opening of the seal and moves the sleeve contacts between the opened and closed positions;

wherein while the socket housing and the assembly connector are joined and the bolt is in the unlocked position, the sleeve contacts are in the opened position, the connector pins are inserted into the sleeve contacts, and the hook latches with the lug and the seal bears on an inner wall of the assembly connector;

wherein while the socket housing and the assembly connector are joined and the bolt is in the locked position, the sleeve contacts are in the closed position, the connector pins inserted into the sleeve contacts are held therein, and the bolt locks latching of the hook with the lug.

2. The plug connector of claim 1 wherein:

the socket housing includes an outer protective housing and a contact carrier that holds the sleeve contacts.

3. The plug connector of claim 1 wherein:

the slider includes a frame having a plurality of molded parts which interlock with the sleeve contacts such that movement of the slider causes movement of the sleeve contacts between the opened and closed positions.

4. The plug connector of claim 3 wherein:

the frame has an oval or rectangular outer contour.

5. The plug connector of claim 1 wherein:

the slider includes a pair of pins and the bolt has a pair of arms, wherein the pins of the slider are respectively connected to the arms of the bolt to connect the slider to the bolt.

6. The plug connector of claim 5 wherein:

the pins extend through respective openings of the seal and move through the openings as the bolt moves.

7. The plug connector of claim 6 wherein:

the slider further includes a frame connected to the pins, the frame having a plurality of molded parts which interlock with the sleeve contacts such that movement of the pins cause movement of the sleeve contacts between the opened and closed positions.

8. An electrical zero force plug type connector comprising:

a plurality of sleeve contacts each having contact blades and a clamping sleeve movable between an opened position in which the clamping sleeve is away from the contact blades and a closed position in which the clamping sleeve presses the contact blades together;

a socket housing holding the sleeve contacts and having a hook and a seal;

an assembly connector having connector pins and a lug;

a bolt arranged on the socket housing and movable against the socket housing from an unlocked position into a locked position after the socket housing and the assembly connector are joined; and a slider extending through an opening of the seal and connected to the bolt and to the clamping sleeves such that as the bolt moves between the unlocked and locked positions the slider moves through the opening of the seal and moves the clamping sleeves between the opened and closed positions;

wherein while the socket housing and the assembly connector are joined and the bolt is in the unlocked position, the clamping sleeves are in the opened position and the connector pins are inserted through the contact blades into the sleeve contacts and the hook latches with the lug and the seal bears on an inner wall of the assembly connector;

wherein while the socket housing and the assembly connector are joined and the bolt is in the locked position, the clamping sleeves are in the closed position and press the contact blades together against the connector pins inserted into the sleeve contacts and the bolt locks latching of the hook with the lug.

9. The plug connector of claim 8 wherein:

the socket housing includes an outer protective housing and a contact carrier that holds the sleeve contacts.

10. The plug connector of claim 8 wherein:

the slider includes a frame having a plurality of molded parts which interlock with the clamping sleeves of the sleeve contacts such that movement of the slider causes movement of the clamping sleeves.

11. The plug connector of claim 10 wherein:

the frame has an oval or rectangular outer contour.

12. The plug connector of claim 8 wherein:

the slider includes a pair of pins and the bolt has a pair of arms, wherein the pins of the slider are respectively connected to the arms of the bolt to connect the slider to the bolt.

13. The plug connector of claim 12 wherein:

the pins extend through respective openings of the seal and move through the openings as the bolt moves.

14. The plug connector of claim 13 wherein:

the slider further includes a frame connected to the pins, the frame having a plurality of molded parts which interlock with the clamping sleeves of the sleeve contacts such that movement of the pins cause movement of the clamping sleeves.

15. The plug connector of claim 13 further comprising:

a secondary bolt connected to the pins and abutting against the clamping sleeves.

16. The connector of claim 8 wherein:

the bolt has a projection, which is first blocked by the hook of the socket housing and which is released after being captured by the hook on the lug of the assembly connector.

17. An electrical zero force plug type connector comprising:

a socket housing holding sleeve contacts movable between opened and closed positions and having a seal;

an assembly connector having connector pins;

a bolt movable against the socket housing from an unlocked position into a locked position after the socket housing and the assembly connector are joined; and a slider extending through an opening of the seal and connected to the bolt and to the sleeve contacts such that as the bolt moves between the unlocked and locked positions the slider moves through the opening of the seal and moves the sleeve contacts between the opened and closed positions;

wherein while the socket housing and the assembly connector are joined and the bolt is in the unlocked position, the sleeve contacts are in the opened position and the connector pins are inserted into the sleeve contacts;

wherein while the socket housing and the assembly connector are joined and the bolt is in the locked position, the sleeve contacts are in the closed position and the connector pins inserted into the sleeve contacts are held therein.

18. The plug connector of claim 17 wherein:

the slider includes a frame having a plurality of molded parts which interlock with the sleeve contacts such that movement of the slider causes movement of the sleeve contacts between the opened and closed positions.

19. The plug connector of claim 17 wherein:

the slider includes a pair of pins and the bolt has a pair of arms, wherein the pins of the slider are respectively connected to the arms of the bolt to connect the slider to the bolt.

20. The plug connector of claim 19 wherein:

the pins extend through respective openings of the seal and move through the openings as the bolt moves.

* * * * *